United States Patent [19]

Ostrowski

[11] Patent Number: 5,056,663

[45] Date of Patent: Oct. 15, 1991

[54] ADJUSTABLE PROTECTIVE BOOK COVER AND METHOD

[76] Inventor: Michael J. Ostrowski, 91 Old Toll Rd., West Barnstable, Mass. 02668

[21] Appl. No.: 588,271

[22] Filed: Sep. 26, 1990

Related U.S. Application Data

[63] Continuation-in-part of Ser. No. 552,794, Jul. 16, 1990, abandoned.

[51] Int. Cl.[5] ..... B42D 3/04

[52] U.S. Cl. ..... 206/424; 53/397; 206/450; 229/87.01; 281/34

[58] Field of Search ..... 206/424, 450; 229/87.01; 281/19.1, 32, 34, 35; 53/397, 452, 455; 150/154

[56] References Cited

U.S. PATENT DOCUMENTS

| | | | |
|---|---|---|---|
| 2,808,274 | 10/1957 | Goldman | 281/34 |
| 3,080,178 | 3/1963 | Brody | 281/34 |
| 3,623,526 | 11/1971 | Robertson | 229/87.01 |
| 3,683,987 | 8/1972 | Robertson | 229/87.01 |
| 4,355,822 | 10/1982 | McHugh | 281/19.1 |
| 4,412,692 | 11/1983 | Williams | 281/34 |
| 4,497,508 | 2/1985 | McHugh | 281/35 |
| 4,527,814 | 7/1985 | Carter et al. | 281/19.1 |
| 4,819,964 | 4/1989 | DuPuis | 281/35 |
| 4,846,500 | 7/1989 | Klang | 281/34 |

FOREIGN PATENT DOCUMENTS

| | | | |
|---|---|---|---|
| 0625134 | 2/1936 | Fed. Rep. of Germany | 281/34 |
| 1100367 | 9/1955 | France | 281/34 |
| 0527606 | 3/1955 | Italy | 281/34 |
| 0016906 | 5/1909 | United Kingdom | 229/87.01 |
| 0178313 | 4/1922 | United Kingdom | 281/34 |

*Primary Examiner*—Jimmy G. Foster
*Attorney, Agent, or Firm*—Richard P. Crowley

[57] ABSTRACT

An adjustable book cover and method wherein the book cover comprises a generally rectangular protective cover material wherein the length of the cover material may be easily adjusted through the use of releasable hook and loop fasteners or adhesive material and wherein the length of the material to fit the book to be protected is adjusted and pockets for the insertion of the book covers in said pockets by the employment of hook and loop fastener straps or adhesive material secured by elastic tabs to the cover material. The method includes providing a rectangular book cover material and folding over the top and bottom edges and securing the edges in place by the use of hook and loop fabric fasteners or an adhesive strip and forming side pockets for insertion of the book covers at each side edge thereof and folding over the side edges and securing the side edges by hook and loop fasteners or adhesive strips, particularly where such fasteners or strips at the side edges are tensioned by the use of elastic material.

29 Claims, 4 Drawing Sheets

ADJUSTABLE PROTECTIVE BOOK COVER AND METHOD

REFERENCE TO PRIOR APPLICATION

This application is a continuation-in-part application of U.S. Ser. No. 07/552,794, filed July 16, 1990 now abandoned.

BACKGROUND OF THE INVENTION

Book jackets or covers to provide protective covering for books or magazines or other publications are widely employed and may be composed of a variety of material, including fabric, plastic and paper and combinations thereof.

It is desirable to provide for a protective book cover material which is easily adjusted so that in length and width it may be adjusted to fit the particular book on which the cover is to be protected. In addition, it is desirable to provide an adjustable book cover or jacket wherein the cover may be easily assembled or disassembled from the book which it is employed.

SUMMARY OF THE INVENTION

The invention relates to an adjustable book cover and a method of securing the book cover to a book. In particular, the invention concerns an adjustable protective book cover and a method wherein releasable fasteners are employed to permit adjustment of the book cover to fit the book to be covered.

An adjustable protective cover or jacket for books, publications and the like has been discovered, which book cover comprises a generally rectangular, foldable, sheet cover material which is a continuous sheet material formed of plastic, such as PVC or nylon, or paper or fabric, such as a thin, plastic, e.g. polyvinyl chloride, inner sheet and a nylon outer sheet preferably with a decorative design thereon. More particularly, the book cover may be a washable fabric, which may be plain or imprinted with a design, or even a combination of nylon and plastic, such as overlapping layers of nylon and fabrics, to form a book cover designed to protect the exterior surface of a book and yet to fit the book in a snug manner and which is easily assembled and disassembled from the book. The rectangular cover material has a top edge, a bottom edge and one and the other side edges and have a front and a back surface.

In one embodiment, the cover material is secured and adjustable relative to the overall length of the book which is to be protected by the employment of tab materials comprising a plurality of tab materials on the back surface of the cover material. The tab materials are spaced apart and extended from the top and bottom inwardly edge. Generally, at least two tab materials are spaced apart and extend from each edge, the tab material composed of one section of hook material and the other section of loop material to engage releasably the hook material. The materials extend in an elongated strip of tab material and are secured, such as by sewing the material, to the back surface of the cover material. The combination of the hook and loop tab material permits the top and bottom edges of the cover sheet material to be pulled over generally and equally from each edge so as to be secured by the hook and loop fastening material to the inner back surface of the cover material so as to form a fold of the cover material of selected width, usually uniform, extending from the top and bottom edge. The folds adjust the length of the cover material to the length of the book to be covered.

In another embodiment, the cover material is secured and adjustable relative to the overall length of the back which is to be covered by the employment of a self-adhesive material, such as a strip of self-adhesive material, extending either continuously or discontinuously a short distance inwardly along the top and bottom edges on the inner surface of the cover material. Typically, the adhesive employed is subject to releasable reuse, so that the cover may be used on different book lengths, and the top and bottom edges peeled away and the book length readjusted by folding on the top and bottom edges and resealing the adhesive materials. The adhesive material need not extend the full length of the top and bottom edges so as to leave room for the fold over of the side edges. Generally, the adhesive material is protected prior to first use by a peelable or removable cover on the adhesive material which is easily removed prior to book adjustment use. The means to adjust and secure the book cover to the length of the back may be by adhesive means or hook-loop materials as other means to provide for easy release and adjustment of the cover material.

The cover material also includes hook and loop fastening elongated strip materials extending from the top and bottom edges and generally adjacent the sides edges, that is, for a total of four hook and loop fastening materials with one end of each material strip secured to the cover material. The hook and loop strip material at the top and bottom edges are of opposite surfaces, that is, a hook or a loop, so that when they meet they may be engaged in a releasable fastening arrangement. The hook and loop strip material extending from the top and bottom edges at each corner of the cover material permits the cover material to provide an easily releasable side pocket on each edge of the cover material so that the front and back covers of the book may be slid into such side pockets and retained in a protective position. Additionally and optionally, but preferably, the hook and loop fastener strip material is secured by a short strip of elastic material, the elastic material secured, such as by sewing, to the cover material at the one end and sewn at the other end to one end of the hook and loop fastener strip material which provides for adjustment in tension to secure the cover material snugly to the book cover. The hook and loop strip material are folded over to engage in a fastening attachment to form the side edge pockets of the book cover.

Rather than employ hook and loop fastener material on a fabric strip, a self-adhesive layer may be used on one or preferably both strips, typically with a peelable or removable adhesive protective strip over the adhesive material which can be removed prior to use and overlapping and self-adhering of the strips to form the side edge pockets of the book cover. As before, the adhesive material used generally and optionally should be subject to releasable removal of the strip and reuse of the adhesive quality of the strip to permit reuse with another book.

The book cover and method therefore provide for an easy, rapid and effective method for adjusting the book cover material into an adjustable, protective book cover for books of various heights, and yet the book cover material may be easily, snugly secured to the book or detached from the book as desired.

The invention will be described for the purposes of illustration only in connection with certain embodiments; however, it is recognized that various modifications, changes, improvements and additions may be to the illustrated embodiments by those persons skilled in the art, and all falling within the spirit and scope of the invention.

DESCRIPTION OF THE EMBODIMENTS

Figure 1:
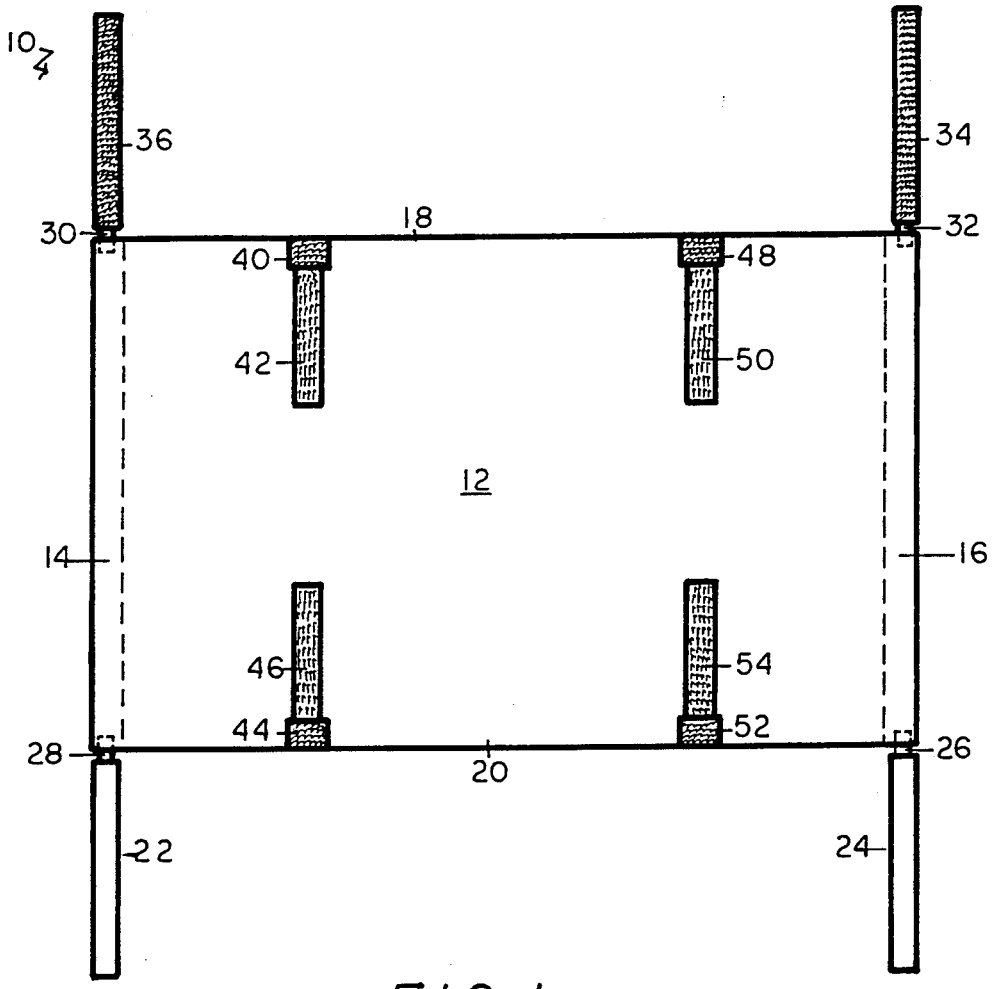
FIG. 1 is a top plan view of the book cover of the invention in an extended, non-covering position, looking at the back surface of the book cover.

FIG. 1 shows a book cover 10 of the invention composed of a woven fabric material 12 in a generally rectangular form and typically for example from 13 inches in height to 22 inches in length and having side edges 14 and 16 and a top edge 18 and a bottom edge 20. The material 12 is a woven fabric sheet material, such as a cotton cloth, designed to provide protection to a book cover. From the top 18 and bottom 20 edges and adjacent the sides 14 and 16 are shown elongated strip materials formed of hook and loop fastening fabric-like materials, like Velcro® strips (a trademark of The Velcro Corporation) 22, 24, 34 and 36, the strips 22, 24, 34 and 36 extending generally at right angles from the top 18 and bottom 20 edges and generally aligned with the side edges 14 and 16 respectively. Strip materials 34 and 36 are illustrated as having a fuzzy material, that is, having the loop-type material, facing upwardly in viewing FIG. 1 from the back surface of the book cover 10, while strips 22 and 24 as shown have a plain fabric surface with a loop-type surface on the opposite side (see FIG. 2). The elongated strip materials 22, 24, 34 and 36 generally are of a length which does not exceed the height of the cover material 12 and represents usually 60% to 80% of such height and is sufficiently long to enable the material to be folded over and engaged in a releasable fastening arrangement when the respective strip materials, for example, 22 and 36 and 24 and 34 are placed in a fastening engagement as illustrated more particularly in FIG. 2. It may be for example one-fourth to 5 inches in width and 4–6 inches in length.

The book cover material 12 has folded over, sewn side edges shown as dotted lines and includes a short elastic strap, doubled over, such as a nylon elastic strap 28, 30, 32 and 26 sewn on one end of the folded over edges of the cover material 12 with the other end secured to the one end of the respective, elongated strip material 22, 24, 34 and 36. Typically, the elastic strap material may extend say one-fourth to one-half from the edge 20 and 18 of the material 12 and has a width of about the same or slightly less than that of the elongated strip material.

The book cover material 12 also includes four strips of tab-like materials sewn to the cover material 12 and composing short, separately sewn tabs 40, 48, 44 and 52 composed of a hook and loop or Velcro® fabric material, as illustrated showing a loop material, and then an adjacent, extended, sewn on, elongated tab material 42, 50, 52 and 46 of the opposite, that is, a hook-type material, the short tab material 48, 44, 52 and 40 are sufficiently wide and of a length to merely permit them to engage a portion of the elongated tab materials 42, 50, 46 and 54 with the length of such elongated tab material generally extending to less than half of the length of the cover material 12, and for example, may range from three-fourth of an inch wide to 3–4 inches in length and be spaced from 4–6 inches from each outside edge 14 and 16 of the cover material 12.

Figure 2:
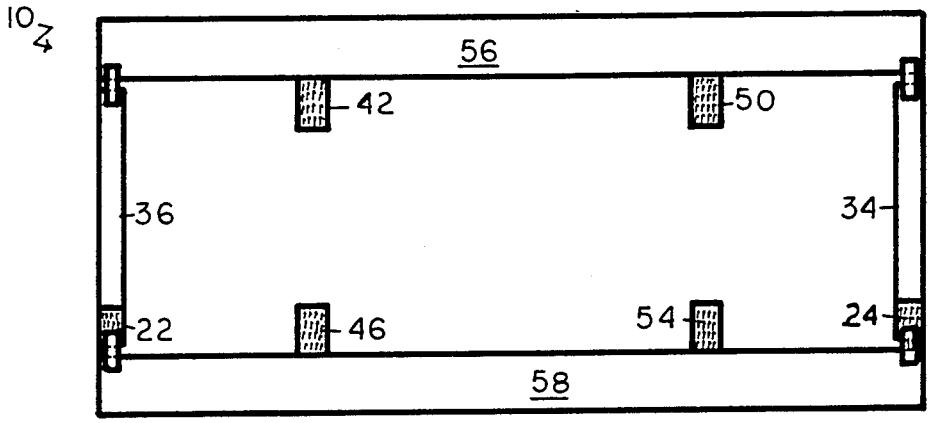
FIG. 2 is a top plan view of the book cover of FIG. 1 with the top and bottom edges folded over in a partially assembled position.

FIG. 2 is an illustration of the book cover 10 wherein the top edge 18 and the bottom edge 20 of the material 12 has been folded over a desired amount in conformance with the length of a book to be covered from top and bottom edges 56 and 58 wherein the edges are held in place via the releasable fastening of the loop material 40, 44, 48 and 52 in a fastening engagement with the hook material of the tab strips 42, 46, 50 and 54. FIG. 2 shows that the elongated tab material 42, 46, 50 and 54 is exposed so that if desired the wider edge 56 and 58 may be formed to fit books of a wide variety of lengths. As also illustrated in FIG. 2, it can be seen that the elongated strips 22, 24, 34 and 36 have been folded over to engage in a releasable, fastening relationship with the hook-like surface of the strips 22 and 24 now visible and with the strip materials 22 and 36 and 24 and 34 now fasteningly engaged by the hook and loop arrangement to form side pockets for receiving the exposed ends of the book covers.

Figure 3:
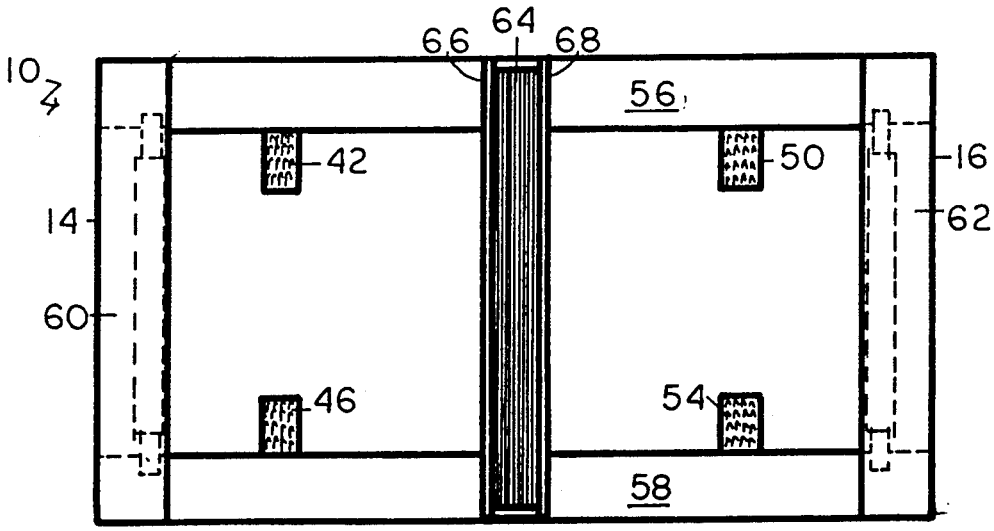
FIG. 3 is a top plan view of the back surface of the book cover of FIG. 1 with both the top, bottom and side edges folded over with a book in position to be covered.

FIG. 3 is an illustration of the book cover 10 of FIG. 2 with a book 64 spline placed intermediate the tab materials and having covers 66 and 68 to be covered and positioned just before covering, and with the side edges 14 and 16 folded over to form uniform side flaps 60 and 62 of sufficient width to make a snug cover over the width of the book 64. The employment of the elongated strap elastic materials 26, 28, 30 and 32 permit the cover material 12 to be snugly fastened in a tension-like manner over the book covers 66 and 68 when the elongated strip materials are engaged in a fastening, releasable arrangement.

Figure 4:
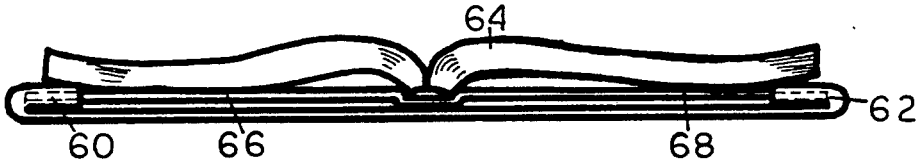
FIG. 4 is an end elevational view of a book in an open position covered with the book cover of FIG. 1.

FIG. 4 is an illustration of the book 64 in an open position and covered by the book cover 10 wherein the side edges 60 and 62 cover the edges of the book covers 66 and 68.

Figure 5:
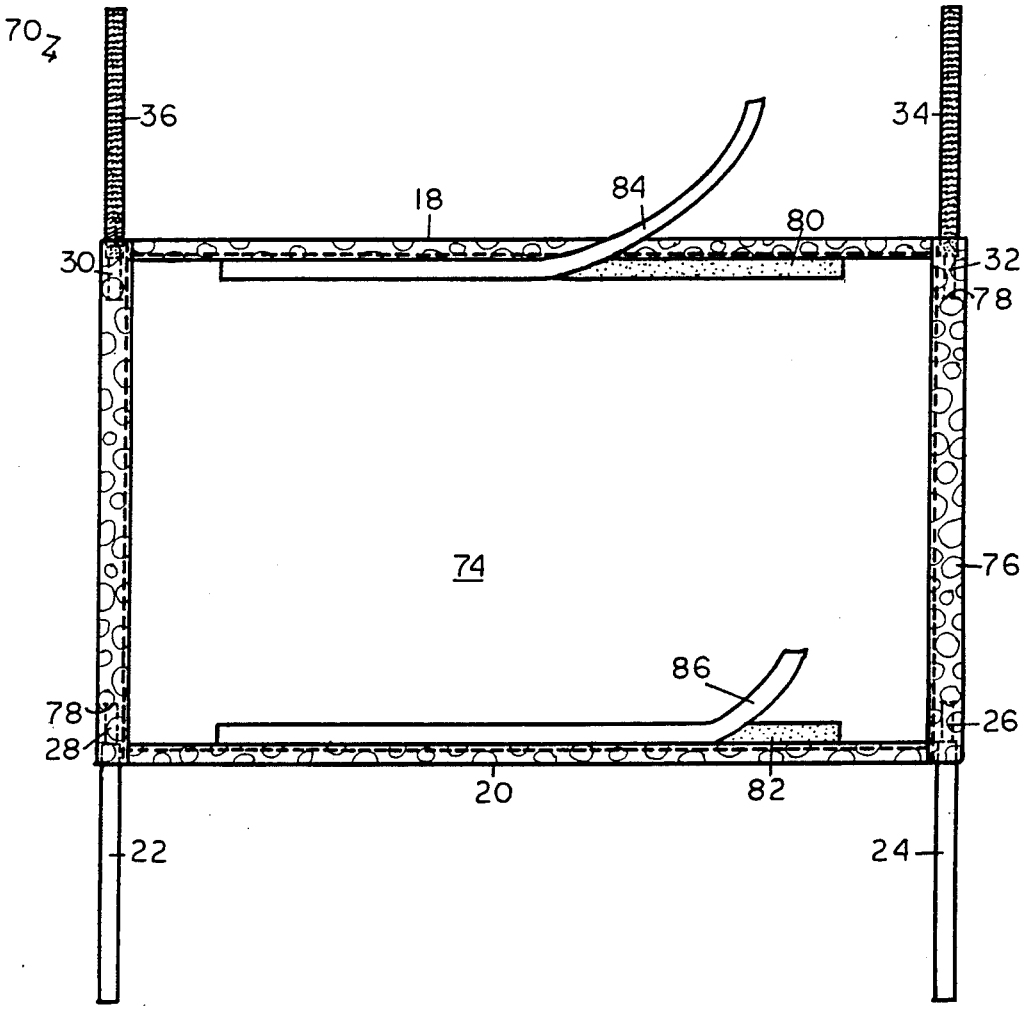
FIG. 5 is a top plan view of the book cover of the invention in another embodiment in an extending, non-covering position looking at the back surface of the book cover.
Figure 6:
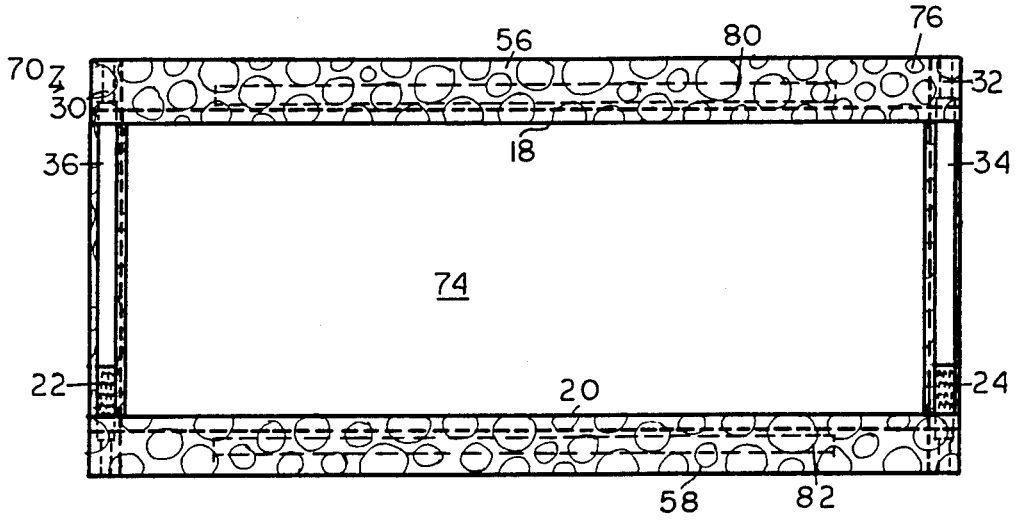
FIG. 6 is a top plan view of the book cover of FIG. 5 with the top and bottom edges folded over in a partially assembled position.
Figure 7:
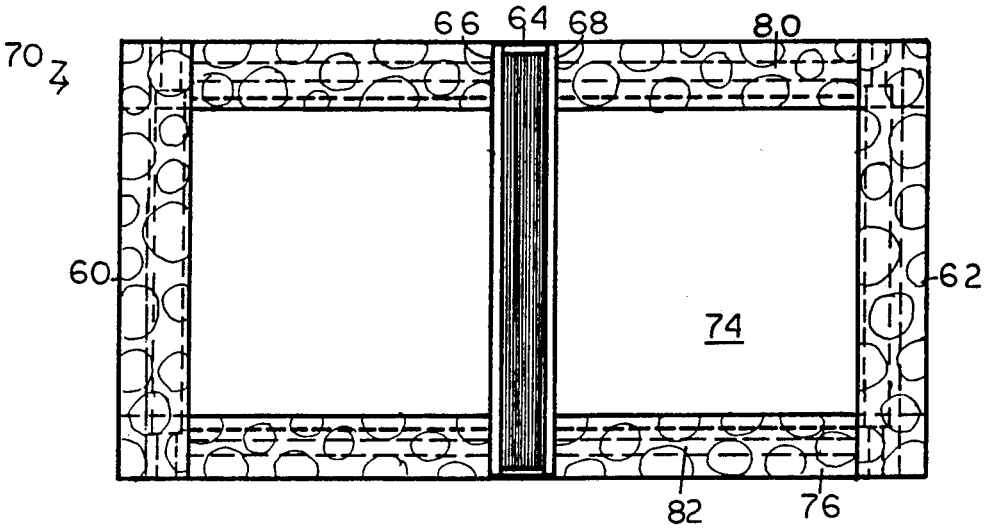
FIG. 7 is a top plan view of the back surface of the back cover of FIG. 6 with the side edges folded over and with a book in a position to be covered.

FIGS. 5, 6 and 7 are directed to another embodiment of the book cover 70 of the invention composed of a composite cover material composed of a plastic polyvinyl chloride inner sheet 74 and an illustrated, decorative nylon fabric outer sheet 76 with edges of the nylon fabric folded over and sewn to the sheet 74. Hook and loop fastener strips 22, 24, 34 and 36 are used and one end secured to elastic strip material 26, 28, 30 and 32, sewingly secured to the cover as shown at 78, but visually hidden within the side folds of the surface fabric 76.

FIG. 5 shows strips of self-adhesive material 80 and 82 extending inwardly a short distance adjacent the top and bottom edges of the cover material 72, such as a strip of one-fourth to one-half inch in width. The adhesive strips 80 and 82 are protected as shown in FIG. 5 with removable, peelable, protective paper strips 84 and 86. The adhesive strip material extends along the length of the top and bottom edges and is of sufficient width and adhesive quality to secure adhesively and releasably the top and bottom folded edges 56 and 58 and with the fastener 36 and 22 and 34 and 24 releasably secured to form side pockets in a folded manner to the book length as shown in FIG. 6.

FIG. 7 illustrates the book 64 with covers 66 and 68 in position to be covered by the book cover 70 of FIGS. 5 and 6.

The book cover of the invention thus provides for an adaptable, adjustable book cover which may be easily adjusted by the use of hook and loop releasable fabric fasteners and adhesive strips both lengthwise of the book to form the top and bottom of the book cover material and also widthwise to form the desired side pockets to the desired width to accommodate the width of the book, and yet the book cover is easily assembled and disassembled by the employment of the releasable hook and loop fasteners or adhesive employed and particularly where the hook and loop fasteners of the strip material contains elastic connections to the book cover material to provide a tight-fitting book cover.

What is claimed:

1. An adjustable, protective cover for books and other publications, which book cover comprises:

a) a generally rectangular, foldable, protective sheet cover material to protect the exterior surface of a book, the cover material having a top edge, a bottom edge and a one and the other side edges and having a front and a back surface;

b) four hook and loop elongated strip fastener means secured to the cover material and extending from each of the top and bottom edges and adjacent the one and the other sides and adapted on folding over toward each other to engage in a releasably, fastening, overlapping arrangement to provide for connected side strips adjacent the one and the other sides of the cover material so as to provide for the insertion of a cover of a book to be protected therein on either side;

c) a plurality of hook and loop tab materials secured to the back surface of the book cover material, each tab material having a hook and a loop section therein adapted on the folding over of the top and bottom edges of the cover material to form an overlapping, releasably fastened edge which can be adjusted to the length of the book to be covered; whereby the side edges of the cover material secured together by the elongated strip material may be folded over to form side pockets for the book cover to be received therein and wherein the tab materials provides for the folding down of the top and bottom edges to adjust to the length of the book to be covered thereby providing an adjustable book cover.

2. The book cover of claim 1 wherein the strip fastener means comprises four elongated strips of hook and loop fastening material secured at the one end to the cover material and having an other free end, two of these strip materials extending from the top edge adjacent the one and the other sides of the cover material and two of the strip materials extending from the bottom edge adjacent one and the other side edges of the cover material, the strips at each side edges of opposite fastening hook or loop surfaces and with one surface facing in an opposite direction and the other facing in the extended position, so that when the elongated strip materials are folded back on each other and over the back surface of the cover material, they engage in a releasable, fastening arrangement generally along the one and the other side edges of the cover material.

3. The book cover of claim 1 wherein the plurality of hook and loop tab materials comprise a plurality of separate tab material of hook and loop fastening materials secured to the back surface of the cover material and extending from the top and bottom edges thereof inwardly from the edges thereof a defined distance, the tab material including a hook section and a loop section, so that the cover material may be folded inwardly onto the back surface to form a fold along the top and bottom edges of the book cover material to adjust the length of the cover material to the height of the book to be covered, the cover material secured in a releasable, fastening arrangement by the opposite surfaces of the tab material engaging in a fastening arrangement at the selected height.

4. The book cover of claim 1 which includes a short elastic strap material secured to the cover material at the one end thereof and secured at the other end thereof to the one end of the hook and loop elongated strip fastener means whereby the strip means may be placed in a releasable, engaging fashion so as to provide for a tension-securing arrangement of the book covers within the side pockets formed by the fastened elongated strip material.

5. The book cover of claim 4 wherein the elastic strap material comprises a nylon, cloth, elastic material sewn at the one end to the book cover material and at the other end sewn to the elongated strip fastener means.

6. The cover of claim 1 wherein each one of the tab material comprises adjacent hook and loop material.

7. The book cover of claim 6 wherein the tab material comprises a generally small, rectangular tab material of hook or loop fastening material, and an elongated strip of fastening hook or loop opposite material extending therefrom and generally perpendicular from the top and bottom edges.

8. The book cover of claim 7 wherein the elongated strip of the tab material extends less than about half of the length of the cover material.

9. The book cover of claim 1 wherein the tab material comprises four tab materials, two extending from the top edge and two from the bottom edge and generally spaced apart from the one and the other side edges and of a distance sufficient to retain the cover material in a top and bottom folded position of the desired height of the book to be covered and not positioned within the spline area of the book to be covered.

10. The book cover of claim 1 wherein the the cover comprises a fabric cover material.

11. The book cover of claim 1 wherein the elongated strip fastener means is the length of about 50% to 100% of the length of the cover material.

12. The adjustable, protective cover of claim 1 and a book covered with said cover.

13. An adjustable, protective cover for books and publications, which book cover comprises:

a) a generally rectangular, foldable, protective sheet cover material to protect the exterior surface of a book, the cover material having a top edge, a bottom edge and a one and the other side edges and having a front and a back surface;

b) four elongated strips of hook and loop strip fastening material having a one end and an other free end, two of the strip materials extending from the top edge adjacent the one and the other sides of the cover material and two of the strip materials extending from the bottom edge adjacent the one and the other side edges of the cover material, the strips of a generally uniform length and not greater than the height of the book cover material, and generally extending outwardly at a right angle to the top and bottom edges of the cover material, the elongated strip fastening material extending from each edge generally aligned and having opposite surfaces so that upon one strip material being folded back onto the other strip material and engaged in a releasable fastening arrangement to form an insert for the insertion of a book cover;

c) an elastomeric material secured at the one end of the cover material and the other end to the one end of the elongated strip material so as to provide for a tight, tensioned arrangement of the fastened elongated strip material about the covers of the book to be protected; and d) at least four separate tabs of hook and loop fastening material secured to the back surface of the cover material and generally spaced inwardly from the side edges a defined distance and having a length less than 50% of the height of the cover material and generally extending from the top and bottom edges of the cover material and generally perpendicularly thereto, the tab material including a short hook or loop section adjacent the top and bottom edges and an elongated hook or loop opposite section extending from the short section whereby on the folding over of the top and bottom edges of the cover material the tab material may be placed in a releasable fastening arrangement so as to form a fold of the cover material over the top and bottom edges to adjust the length of the cover material to fit the height of the book to be covered, and the fastening material may be folded over to form side pockets for the elongated insertion of the book covers.

14. The cover of claim 13 and a book covered by said cover.

15. A method of covering a book or a publication, which method comprises:

a) folding over the top and bottom edges of the book cover of claim 1 to a defined height distance of the book and securing the folded edges by the hook and loop fabric fastening arrangement of the tab materials;

b) folding over the side edges of the cover material to form side pockets for the insertion of the book cover and securing the elongated strip fastener means in a hook and loop releasable fastening arrangement; and c) slipping the respective covers of the book into the side pockets, so that the side edges of the cover material releasably fastened together extend over the book cover thereby providing a protective book cover.

16. An adjustable, protective cover for books and other publications, which book cover comprises:

(a) a generally rectangular, foldable, protective sheet cover material to cover the exterior surface of a book, the cover material having a top edge, a bottom edge and a one and the other side edges and having a front and a back surface;

(b) four strip fastener means secured to the cover material and extending from each of the top and bottom edges at about the one and the other sides and adapted on folding over toward each other to engage in a releasably, fastening, overlapping arrangement to provide for connected side strips adjacent the one and the other sides of the cover material so as to provide side pockets for the insertion of a cover of a book to be protected therein on either side; and (c) length-adjusting fastening means secured to the back surface of the book cover material and generally adjacent the top and bottom edges of the cover material, and adapted on the folding over of the top and bottom edges of the cover material to form an overlapping, releasably fastened edge to the inside surface of the cover material adjusted to the length of the book to be covered;

whereby the side edges of the cover material secured together by the strip fastener means may be folded over to form side pockets to the book cover to be received therein and wherein the length-adjusting fastener provides for the folding down of the top and bottom edges to adjust to the length of the book to be covered thereby providing an adjustable book cover.

17. The book cover of claim 16 wherein the strip fastener means comprises four elongated strips having a one and other end and secured at the one end to the cover material and the other end free, two of the said strip materials extending from the top edge adjacent the one and the other sides of the cover material and two of the said strip materials extending from the bottom edge adjacent one and the other side edges of opposite fastener means surfaces, and with one surface facing in an opposite direction and the other surface facing in the extended position, so that when the elongated strip materials are folded back on each other and over the back surface of the cover material, the surfaces engage in a releasable, fastening arrangement generally along the one and the other side edges of the cover material.

18. The book cover of claim 16 wherein the length-adjusting fastening means comprise a plurality of separate tab materials of hook and loop fastening materials secured to the back surface of the cover material and extending from the top and bottom edges thereof and inwardly from the edges thereof a defined distance, the tab materials including a hook section and a loop section, so that the cover material may be folded inwardly onto the back surface to form a fold along the top and bottom edges of the book material to adjust the height of the cover material to the height of the book to be covered, and the cover material secured in a releasable, fastening arrangement by the opposite surfaces of the tab material engaging in a fastening arrangement at the selected height.

19. The book cover of claim 18 wherein the tab material comprises at four tab materials, two extending from the top edge and two from the bottom edge and generally spaced apart from the one and the other side edges and of a distance sufficient to retain the cover material in a top and bottom folded position of the desired height of the book to be covered and not positioned within the spline area of the book to be covered.

20. The book cover of claim 16 which includes a short elastic strap material having a one and other end and secured to the cover material at the one end thereof and secured at the other end thereof to one end of the strip fastener means whereby the strip material may be placed in a releasable, engaging fashion so as to provide for a tension-securing arrangement of the book covers within the side pockets formed by the fastened strip fastening means.

21. The book cover of claim 20 wherein the elastic strap material is positioned in a non-visible position within a folded edge of the sheet cover material.

22. The book cover of claim 16 wherein the length-adjusting means comprises adjacent hook and loop material.

23. The book cover of claim 16 wherein the cover comprises a composite sheet cover material having an inner flexible plastic material and an outer nylon woven material.

24. The book cover of claim 16 wherein the strip fastener means comprises releasable hook and loop fastening material.

25. The book cover of claim 16 wherein the strip fastener means comprises elongated strips of an adhesive material covered by a removable protective strip which protective strip is removed prior to folding over the sides to form side pockets for the book.

26. The book cover of claim 16 wherein the length-adjusting fastening means comprises an elongated strip of an adhesive material covered by a removable protective strip, which protective strip is removed prior to folding over the top and bottom edges to adjust the sheet cover material to the length of the book.

27. The adjustable, protective cover of claim 16 and a book covered by said cover.

28. A method of covering a book or a publication, which method comprises:

(a) folding over the top and bottom edges of the book cover of claim 16 to a defined book length distance and securing the folded over edges by the length-adjusting fastening means;

(b) securing the strip fastener means to form side pockets for the book covers;

(c) folding over the side edges of the cover material to fit the width of the book; and (d) slipping the covers of the book into the side pockets thereby providing a protective book cover.

29. An adjustable, protective cover for books and publications, which book cover comprises:

a) a generally rectangular, foldable, protective sheet cover material to protect the exterior surface of a book, the cover material having a top edge, a bottom edge and a one and the other side edges and having a front and a back surface;

b) four elongated strips of hook and loop fastening material having a one end and an other free end, two of the strip materials extending from the top edge adjacent the one and the other sides of the cover material and two of the strip materials extending from the bottom edge adjacent the one and the other side edges of the cover material, the strips of a generally uniform length and not greater than the height of the book cover material, and generally extending outwardly at a right angle to the top and bottom edges of the cover material, an elongated strip material extending from each edge generally aligned and having opposite surfaces so that upon one strip material being folded back onto the other strip material and engaged in a releasable fastening arrangement to form an insert for the insertion of a book cover;

c) an elastomeric material secured at the one end of the cover material and the other end to the one end of the elongated strip material so as to provide for a tight, tensioned arrangement of the elongated strip material about the covers of the book to be protected; and d) a strip of adhesive fastening material secured to the back surface of the cover material and generally spaced inwardly from and parallel to the top and bottom edges of the cover and having a removable protective strip material thereon whereby on the folding over of the top and bottom edges of the cover material the tab material may be placed in a releasable fastening arrangement so as to form a fold of the cover material over the top and bottom edges and to adjust the length of the cover material to fit the length of the book to be covered, and the elongated fastening material may be folded over to form side pockets for the insertion of the book covers.

* * * * *